United States Patent [19]

Allen

[11] Patent Number: 5,009,413

[45] Date of Patent: Apr. 23, 1991

[54] AQUATIC AMUSEMENT DEVICE

[76] Inventor: Tate C. Allen, 314 Cedar St., New Canaan, Conn. 06840

[21] Appl. No.: 443,711

[22] Filed: Nov. 29, 1989

[51] Int. Cl.[5] ..... E04H 3/16

[52] U.S. Cl. ..... 272/1 B; 446/153

[58] Field of Search ..... 272/1 B; 446/153

[56] References Cited

U.S. PATENT DOCUMENTS 3,091,453 5/1963 Bennett ..... 272/1 B 3,509,584 5/1970 Sable ..... 272/1 B

*Primary Examiner*—Richard E. Chilcot, Jr.

*Attorney, Agent, or Firm*—Joseph J. Kaliko

[57] ABSTRACT

A tube with a restricted end is used to produce a spray of water by manually forcing the non-restricted end of the tube into a body of water. The resulting spray comes out of the restricted end of the tube. Thus, the spray is not in line with the direction of force needed to achieve the spraying action. The tube and restriction combination provides a device that can be used for aquatic amusements, exercise, etc., in an inherently safe manner.

20 Claims, 1 Drawing Sheet

AQUATIC AMUSEMENT DEVICE

BACKGROUND OF THE INVENTION

1. Field of The Invention

The present invention relates generally to amusement devices and more particularly relates to aquatic type amusement devices.

2. Brief Description of the Related Art

Children of all ages have found that when they are playing in a body of water, a hand shaped like a scoop can force a spray or stream of water a relatively long distance when the hand is propelled forwardly over the surface of the water with a portion of the palm of the hand below the surface of the water. Competitive games have been played when so forming a spray or streams of water and directing the same against opponents or against a buoyant body such as a beach ball.

Bennett, in U.S. Pat. No. 3,011,453, teaches an amusement device which permits a user thereof to direct the spray or stream of water a distance greater than is possible by using the hand of the user as a scoop.

To achieve this object, Bennett describes a conically shaped device that fits onto the palm of a user's hand. The device is comprised of an elongated open ended tunnel member, tapering from one end to the other.

When attached to the user's hand and partially submerged under water, the device directs and enhances a spray that results from the application of a forward stroke of the user's hand.

Although such a device achieves its objectives of providing amusement, affording exercise of the muscles of the arm for rehabilitative purposes, lends itself to manufacturing at reasonable costs, etc., it would be desirable to be able to enjoy the benefits of such a device without the fear and potential for injury inherent in using it. Unfortunately, Bennett's apparatus, the front of which is pointed, must be forcibly propelled in a forward direction in order to, for example, spray an opponent standing in front of the device.

More generally, it would be desirable to be able to direct a spray, or even several streams of water, in directions that are not in line with the direction of force exerted on the device which produces the spraying action.

Additionally, it would be desirable to add further safety features to such devices to reduce the inherent prospects of injury when such devices are used at play, for rehabilitative purposes, etc.

Furthermore, it would be desirable to be able to easily change either (or both) the force and the direction of the spray produced using an aquatic device designed with the aforementioned safety features in mind.

Further yet, it would be desirable to achieve all of the aforementioned features with an aquatic device that may be manufactured in a variety of sizes, using a variety of materials, and which lends itself to manufacture at a cost which is both reasonable and commercially practical.

SUMMARY OF THE INVENTION

Accordingly, it is an object of the invention to provide an aquatic device which permits a user thereof to direct a spray (one or more streams) of water in directions that are not in line with the direction of force exerted on the device to achieve the spraying action.

It is a further object of the invention to provide an aquatic device that can be used for amusement purposes, exercise, etc., and which is inherently safe in that its use does not require the thrusting of a pointed object in the general direction of the target of the spray.

Furthermore, it is an object of the invention to provide an aquatic device which can be easily modified to permit streams of water to be sprayed in a multiplicity of directions simultaneously.

Further yet, it is an object of the invention to provide an aquatic device which produces a spray of water which can be easily adjusted in terms of force as well as direction.

According to an embodiment of the invention, a tube having a uniform internal diameter and a restriction at one end is used to produce the desired spray and achieve certain other of the objectives of the invention.

The restriction can be fabricated as an integral part of the tube by, for example, causing the internal diameter of the tube to taper down (instead of being uniform) from the end at which water is introduced, to the more restricted end at which the water is sprayed out. However, it is possible to create the restriction by inserting a restriction device, like a stopper with at least one opening, placed in one end of the tube.

According to an illustrative embodiment of the invention, the restriction device is a plastic insert held in place by crimping one end of the tube. Other means for securing the restriction device, e.g. mating threads between the restriction device and tube, snap lock arrangments between the restriction device and tube, etc., can be envisioned and utilized by those skilled in the art.

The tube and restriction combination contemplated by the invention is used by manually forcing the non-restricted end of the tube into a body of water, with the spray coming out of the restricted end of the tube. Thus, the spray is not in line with the direction of force needed to achieve the spraying action. For example, a player standing in a swimming pool could force the non-restricted end into the pool and cause a spray to come out of the restricted end to push a volley ball across the pool, squirt an opponent, etc.

The tube and restriction combination contemplated by the invention can have a soft attachment for the unrestricted end to prevent injury to other players when using the device. Furthermore, according to one embodiment of the invention, the restriction device can be easily changed or replaced with devices having different size restrictive openings and shapes to facilitate producing sprays having differeing amounts of force and/or direction.

These and other objects and features of the present invention and the manner of obtaining them will become apparent to those skilled in the art, and the invention itself will be best understood by reference to the following detailed description read in conjunction with the accompanying Drawing.

DETAILED DESCRIPTION

Figure 1:
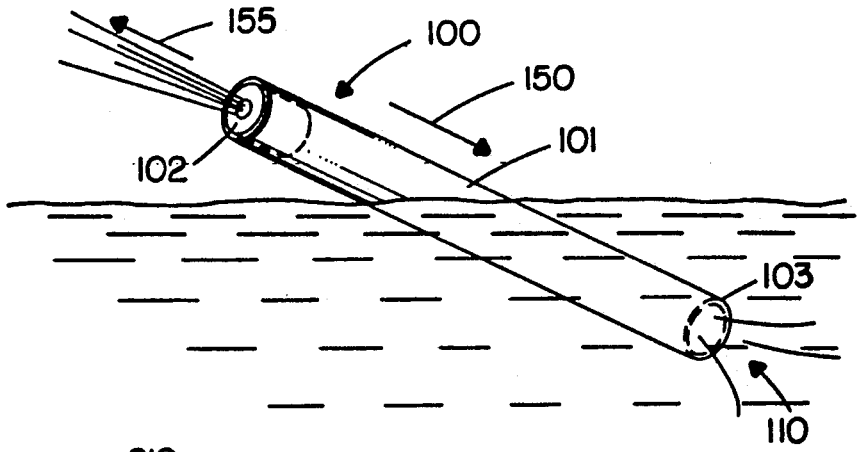
FIG. 1 depicts a device constructed in accordance with the teachings of the invention and which illustrates the principles thereof.

Referring to the Drawing, in which like numerals indicate like parts throughout the several views, the device of the present invention is designated, in FIG. 1, by the numeral 100 and it comprises a tube, 101, that includes a restriction on one end, 102.

Tube 101 can be fabricated from any one of a number of materials including wood, metal, plastic or glass. The particular material used is not meant to be a limiting aspect of the invention. All that is required is that the tube maintain its shape when thrust into the water and that the tube have the aforementioned restriction on one end.

Figure 4:
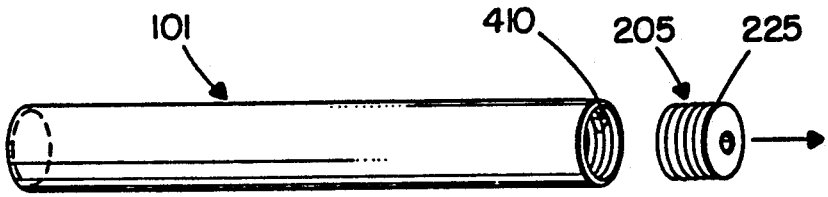
FIG. 4 depicts an embodiment of the invention incorporating means for removing and replacing the restriction device.

The restriction, as indicated hereinbefore, can be made an integral part of the tube or, alternatively, comprises a restriction device which can be inserted into one end of the tube and held there via crimping the tube, via mating threads on the restriction device and tube interior (as depicted in FIG. 4), via a snap lock arrangment, etc. The particular type of mechanism used to fasten the restriction device within the tube is also not meant to be a limiting aspect of the invention. What is important, is that any restriction device used, if not an integral part of the tube, be held in place therein.

FIG. 1 goes on to depict the general direction of force exerted by the user, indicated by arrow 150, relative to the general direction of the resulting spray, indicated by arrow 155. It can clearly be seen that when device 100 is thrust into the water, along the general direction of arrow 150, the spray produced is in a direction other than the direction of force exerted by the user on device 100.

In use, device 100 is grasped by a user in an initial position with the unrestricted end of the tube, 103, submerged. End 103 is then forcibly thrust into the water. Water enters device 100 through end 103, as indicated at location 110 in FIG. 1, and exits in the form of a spray through restricted end 102. To continue spraying water, the device need only be returned in proximity to its initial position, followed by the thrust in the general direction of arrow 150 being repeated.

Figure 2:
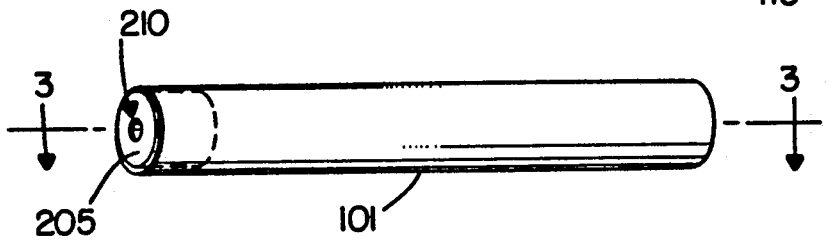
FIG. 2 is a front elevational view of the restricted end of the device shown in FIG. 1.

FIG. 2 depicts a front elevational view of the restricted end of the device shown in FIG. 1. In particular, in accordance with one embodiment of the invention, plastic stopper 205 is depicted, wherein stopper 205 was an opening 210 therethrough. Stopper 205 can be inserted into or be fabricated as part of device 100, and will serve as a suitable restriction device so long as fluid can pass from within hollow tube 101 to the atmosphere outside restricted end 102.

Figure 3:
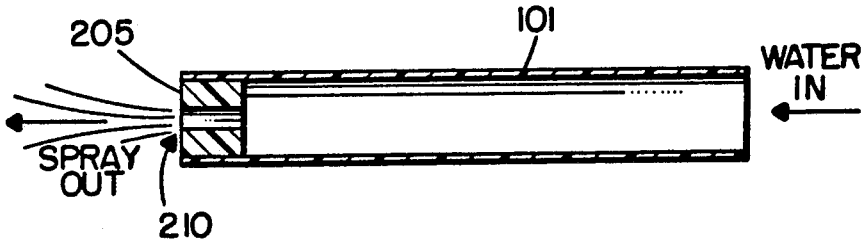
FIG. 3 is a view taken on line 3—3 of FIG. 2.

FIG. 3 depicts a view taken along line 3—3 of FIG. 2 and represents stopper 205 with opening 210. Opening 210 is shown to allow fluid communication between the inside of tube 101 and the atmosphere outside restricted end 102 of tube 101.

As indicated hereinbefore, FIG. 4 depicts an embodiment of the invention incorporating means for easily removing and replacing the restriction device.

The arrangment depicted in FIG. 4 contemplates threads 225 on restriction device 205. The interior of tube 101 can be machined to accept the threaded restriction device and hold it in place. The grooves for mating with threads 225 are shown within 101 as grooves 410 in FIG. 4.

If tube 101 is made of suitable material, the restriction device could be held in place by simply crimping one end of the tube onto the restriction device.

Also, as indicated hereinbefore, a restriction can even be built into tube 101, however, this will limit the ability to easily modify the force and direction of spray. By way of contrast, FIG. 5 illustrates how restriction device inserts can be easily used to modify the force and/or direction of spray produced using device 100.

Figure 5:
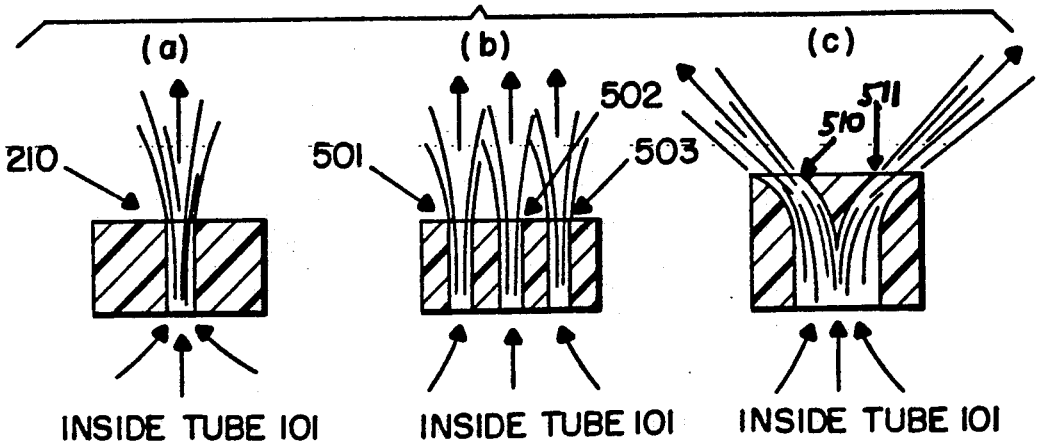
FIG. 5*a*, FIG. 5*b* and FIG. 5*c* depict cutaway views of three exemplary restriction devices which can be used as part of the combination contemplated by the invention, for varying the direction and/or force of the spray produced by the device.

FIG. 5 depicts a cutaway view of three exemplary restriction devices which can be used as part of the combination contemplated by the invention. Each device will cause the resulting spray to vary in either direction, force or both force and direction.

The restricted device labeled (a) in FIG. 5 represents a stopper, like device 205 with opening 210 of FIG. 3, having a central hole through the stopper which allows a single stream of water to come out of the restricted end of the tube.

To vary the force of the spray, opening 210 can be made larger (less force) or smaller (increased force).

The portion of FIG. 5 labeled (b) shows a restriction device with 3 openings, (501, 502 and 503). These allow different streams of water to be produced by device 100. Again, the diameter of the 3 openings can be varied to allow for different degrees of pressure in the resulting streams.

Finally, FIG. 5 depicts a restriction device labeled (c) with curved channels 510 and 511 leading from the hollow portion of tube 101 to the atmosphere. This is but an example of how sprays can be produced that can be directed in a multiplicity of non-linear directions.

According to yet another embodiment of the invention, device 100 of FIG. 1 can be adapted to include a protective rubber coating on at least one end (for example unrestricted end 103) of tube 101, or even a resilient attachment thereto to further enhance the safety features of the device. Furthermore, the outside of tube 101 can be grooved or otherwise provided with means to enhance a user's grip. Such means for enhancing a user's grip on device 100 will further help reduce accidents.

Further adaptations of the tube to enhance its ability to collect and discharge water, such as flaring end 103, etc., are also contemplated by the invention.

What has been described is a device meeting all of the objectives set forth hereinbefore. Those skilled in the art will recognize that the foregoing description has been presented for the purposes of illustration and description only. It is not intended to be exhaustive or to limit the invention to the precise form disclosed, and obviously many modifications and variations are possible in light of the above teaching.

The embodiments and examples set forth herein were presented in order to best explain the principles of the instant invention and its practical application to thereby enable other skilled in the art to best utilize the instant invention in various embodiments and with various modifications as are suited to the particular use contemplated.

What is claimed is:

1. Apparatus for producing a spray of water, comprising:

(a) a tube; and (b) a restriction device combined with said tube, to form an internal restriction at one end of said tube, wherein a spray of water is produced when the unrestricted end of said tube is forcibly thrust into a body of water.

2. Apparatus as set forth in claim 1 wherein said tube has a uniform internal diameter.

3. Apparatus as set forth in claim 1 wherein said tube has a tapered interior, tapering down from the unrestricted end of said tube to the restricted end of the tube.

4. Apparatus as set forth in claim 1 wherein said restriction device is a stopper with an opening to provide fluid communication between the interior of said tube and the atmosphere outside the tube.

5. Apparatus as set forth in claim 4 wherein said tube is capable of receiving and holding an inserted restriction device in place.

6. Apparatus as set forth in claim 1 wherein said restriction device is formed as an integral part of said tube.

7. Apparatus as set forth in claim 1 wherein said restriction device is a stopper having a plurality of channels for fluid communication between the interior of said tube and the atmosphere outside of said tube, to thereby enable a plurality of streams of water to be produced by forcibly thrusting the unrestricted end of said tube into a body of water.

8. Apparatus as set forth in claim 1 wherein said restriction device is a stopper having at least one non linear channel for fluid communication between the interior of said tube and the atmosphere outside said tube, to thereby enable a stream of water to be produced that is directed to one side of the path immediately in front of the restricted end of said tube.

9. Apparatus as set forth in claim 1 further comprising a protective attachment for at least one end of said tube to help prevent injury to any person or object struck by said tube.

10. Apparatus as set forth in claim 1 further comprising a resilient coating placed on at least one end of said tube, not interferring with fluid communcation between the interior of the tube and the atmosphere, to help prevent injury to any person or object struck by said tube.

11. Apparatus as set forth in claims 1 wherein the exterior of said tube is provided with means for enhancing a user's grip on the tube.

12. Apparatus as set forth in claim 1 further comprising means for enhancing the ability of said tube to collect water.

13. Apparatus for providing a spray of water comprising a tube having an internal restriction at one end wherein a spray of water is produced when the unrestricted end of the tube is forcibly thrust into a body of water.

14. Apparatus as set forth in claim 13 wherein said internal restriction is fabricated as an integral part of said tube.

15. Apparatus as set forth in claim 13 wherein said internal restriction is achieved by a restriction device which is inserted into one end of said tube.

16. Apparatus for producing a spray of water comprising the combination of:

a tube having a uniform internal diameter;

(b) a restriction device; and (c) means for retaining said restriction device within said tube at a first end of said tube, whereby said spray of water is produced by forcibly thrusting a submerged second end of said tube into a body of water.

17. Apparatus as set forth in claim 16 wherein said restriction device is retained within said tube by crimping said first end of the tube over a portion of said restriction device.

18. Apparatus as set forth in claim 16 wherein said restriction device is retained in said tube by mating threads located on both said restriction device and the interior of said first end of said tube.

19. Apparatus as set forth in claim 16 wherein said restriction device is retained within said tube utilizing a snap lock arrangment.

20. Apparatus as set forth in claim 16 wherein the restriction device retained in said tube can be removed thereby facilitating replacement of a given restriction device and the introduction of alternate restriction devices which have the capability of causing the production of sprays having differing force and/or direction.

* * * * *